US009168443B2

(12) United States Patent
Edison

(10) Patent No.: US 9,168,443 B2
(45) Date of Patent: Oct. 27, 2015

(54) METHOD AND GOLF BALL FOR PLAYING A GOLF GAME

(76) Inventor: David Edison, London (GB)

( * ) Notice: Subject to any disclaimer, the term of this patent is extended or adjusted under 35 U.S.C. 154(b) by 0 days.

(21) Appl. No.: 13/499,585

(22) PCT Filed: Oct. 1, 2010

(86) PCT No.: PCT/GB2010/051643

§ 371 (c)(1),
(2), (4) Date: Mar. 30, 2012

(87) PCT Pub. No.: WO2011/039547

PCT Pub. Date: Apr. 7, 2011

(65) Prior Publication Data

US 2013/0090186 A1 Apr. 11, 2013

(30) Foreign Application Priority Data

Oct. 2, 2009 (GB) ..... 0917230.5

(51) Int. Cl.

| | |
|---|---|
| ***A63B 69/36*** | (2006.01) |
| ***A63B 67/02*** | (2006.01) |
| ***A63B 43/00*** | (2006.01) |
| ***A63B 45/02*** | (2006.01) |
| *A63B 37/00* | (2006.01) |
| *A63B 57/00* | (2015.01) |

(52) U.S. Cl.

CPC ..... *A63B 67/02* (2013.01); *A63B 37/0022* (2013.01); *A63B 43/00* (2013.01); *A63B 43/008* (2013.01); *A63B 45/02* (2013.01); *A63B 37/0003* (2013.01); *A63B 57/00* (2013.01)

(58) Field of Classification Search

USPC ..... 473/280, 281, 351, 378, 406, 409

See application file for complete search history.

(56) References Cited

U.S. PATENT DOCUMENTS

| | | | | | |
|---|---|---|---|---|---|
| 676,506 | A * | 6/1901 | Knight | 473/268 |
| 3,420,529 | A * | 1/1969 | Hennigan et al. | 473/218 |
| 4,867,450 | A * | 9/1989 | Katz | 473/459 |
| 5,013,046 | A * | 5/1991 | Koch | 473/200 |
| 5,511,782 | A * | 4/1996 | Maley | 473/569 |
| 6,231,459 | B1 * | 5/2001 | Pettigrew et al. | 473/351 |
| D500,108 | S * | 12/2004 | Carbonero | D21/707 |
| 6,852,039 | B2 * | 2/2005 | Pettigrew et al. | 473/280 |
| 7,691,005 | B2 * | 4/2010 | Mitsuba | 473/280 |
| 2003/0198924 | A1 * | 10/2003 | Eite | 434/251 |

* cited by examiner

*Primary Examiner* — Nini Legesse

(74) *Attorney, Agent, or Firm* — Donn K. Harms

(57) ABSTRACT

Golf balls comprising a plurality of markings, each relating to a different future action in a game of golf, the future action generally being the type of club to be used on a future shot. Methods of playing games of golf using the balls are also described herein. Once a shot has been played the marking on the golf ball that lies uppermost is used to determine the future action.

26 Claims, 2 Drawing Sheets

METHOD AND GOLF BALL FOR PLAYING A GOLF GAME

FIELD OF THE INVENTION

The present invention relates to a method and golf ball for playing a game of golf.

BACKGROUND OF THE INVENTION

Golf is a sport in which competing players, using different types of clubs, attempt to hit balls into each hole on a golf course within the fewest number of strokes. The game is played on golf courses, each of which features a unique design, although courses normally consist of either 9 or 18 holes. Golf is defined, in the rules of golf, as "playing a ball with a club from the teeing ground into the hole by a stroke or successive strokes in accordance with the Rules".

The Rules of golf, first administered by the Royal and Ancient Golf Club of St Andrews (R&A) in 1897, have since been internationally standardized, and have been jointly administered by the R&A and the United States Gold Association since 1952.

The fundamental principles of the game as embodied in the Rules have changed little over the last Century, and despite alternate games such as 'pitch and putt' and 'crazy golf' having been developed, little in the way of innovation to the Rules of golf has occurred.

To some extent, although golf is a highly respected and valued sport, there has been a failure to innovate in the sport and lack of modification of the rules of golf has failed to introduce new challenges and opportunity for variety.

The present invention seeks to address these problems.

SUMMARY OF THE INVENTION

According to the present invention there is provided a golf ball comprising a plurality of markings positioned on the exterior surface of the ball that are determinative of future actions to be taken in a game of golf, such as the use of a specific golf club by a player, depending upon the orientation of the markings to the playing surface on which the ball rests after being struck by a golf club during the game.

In one mode of the device, preferably at least one of the markings is determinative of which golf club a player uses on a future shot. More preferably a plurality of the markings are determinative of which golf club a player uses on a future shot. In some embodiments six markings are determinative of which golf club a player uses on a future shot. In other embodiments seven markings are determinative of which golf club a player uses on a future shot. Preferably each of the aforementioned markings represents a different future action to be taken in a game of golf.

In some embodiments at least one marking is determinative of the style in which a future shot is to be played.

Preferably the golf ball comprises at least two different markings. More preferably the golf ball comprises at least three different markings. Even more preferably the golf ball comprises at least four different markings. Even more preferably the golf ball comprises at least five different markings. Even more preferably the golf ball comprises at least six different markings. In some embodiments the golf ball comprises at least seven different markings.

Preferably at least one of the markings determines use of a wood.

Preferably at least one of the markings determines use of a wedge.

Preferably at least one of the markings determines use of a putter.

Preferably at least one of the markings determines use of an iron. More preferably two of the markings determine the use of irons. Even more preferably one of the markings determines the use of a 3-iron and another of the markings determines the use of a 7-iron.

In some embodiments at least one of the markings determines that the player is to use a club that has been pre-selected before beginning a game of golf. Preferably the club has been voluntarily pre-selected by the player.

In some embodiments at least one of the markings determines that the player may select a golf club to use on a future shot. In some embodiments the marking on the surface of the ball in the orientation relative to the surface of the course after landing from being struck, acts as an indicator that determines that a player may choose which golf club from the plurality in the set of golf clubs, to use on a future shot may be a blank area.

In some embodiments the future shot is the next shot taken by a player using the golf ball.

In some embodiments at least one of the markings determines that the player may select a golf club for a different player to use on a future shot.

Preferably at least some of the markings are located in areas on the surface of the golf ball that are separated by dividing lines.

According to another aspect of the present invention there is provided a method of playing a game of golf comprising the steps of:

i) providing at least one player with a golf ball having a plurality of markings on its exterior surface which are positionable to an orientation upon landing to determine a determined golf club, from a plurality in the player's set of clubs, that the player must use on a future shot to be taken in the game of golf;

ii) the player playing a shot with the golf ball;

iii) when the golf ball has come to rest determining the orientation of the markings on the golf ball relative to the playing surface to determine a said marking designating a future action for the player in the game.

Preferably when the golf ball comes to rest on the playing surface of the course at least one of the markings is positioned in an orientation determinative of a future action in the game such as the golf club that a player uses for a future shot. Even more preferably a plurality of the markings are determinative of the type of golf club that a player uses for a future shot.

Preferably the player is provided with a selection of golf clubs.

Preferably when the golf ball has come to rest on the course the uppermost marking on the golf ball relative to its position on the course surface, is used to determine a future action in the game.

In some embodiments the future shot is the next shot taken by a player using the golf ball. In other embodiments the future shot may be a shot taken by a different player.

Preferably the game comprises a plurality of players that are each provided with respective golf balls.

In some embodiments before the game begins each player pre-selects one or more clubs to relate to at least one of the markings on the golf ball.

In some embodiments if the marking relating to the pre-selected club determines the player should use the pre-selected club for a future shot then the player continues to use the pre-selected club until a hole of golf is completed regardless of any subsequent orientation of the golf ball.

In some embodiments when a player's golf ball lands on a green the player will continue to use the club with which they took their most recent shot until a hole of golf is completed.

DESCRIPTION OF THE PREFERRED EMBODIMENTS

Figure 1:
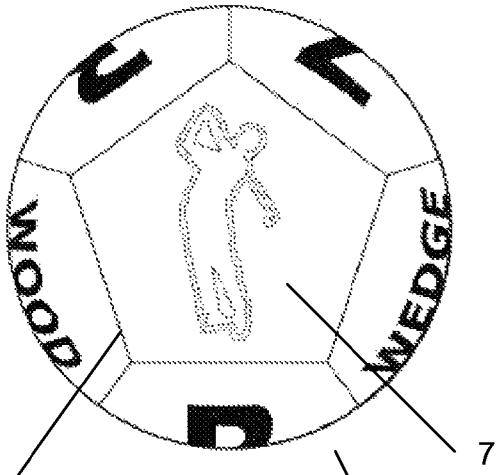
FIG. 1 is a schematic plan view of a golf ball according to a first embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations or modifications in the illustrated device, and any further applications of the principles of the invention as illustrated therein are contemplated as would normally occur to one skilled in the art to which the invention relates.

Figure 2:
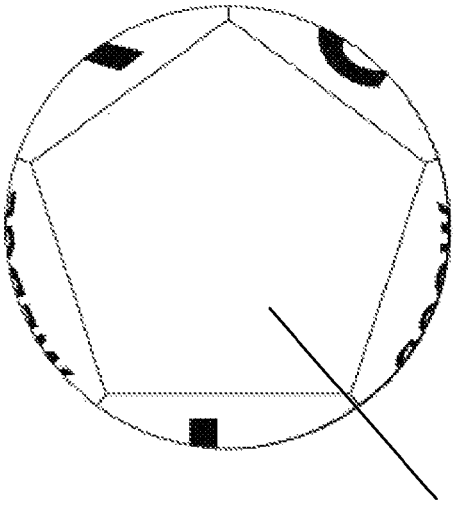
FIG. 2 is a schematic view of the underside of a golf ball according to a first embodiment of the present invention.
Figure 3:
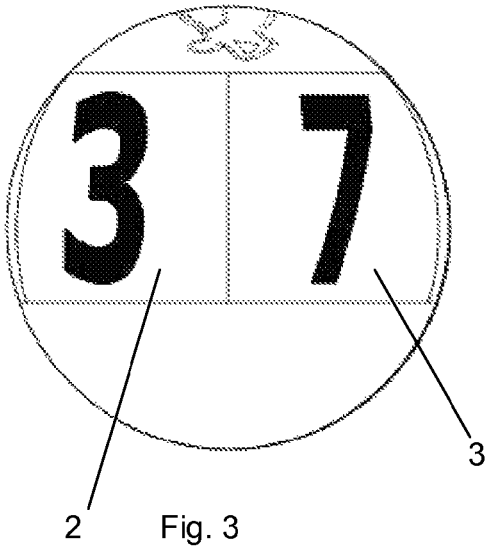
FIG. 3 is a schematic view of the front of a golf ball according to a first embodiment of the present invention.
Figure 4:
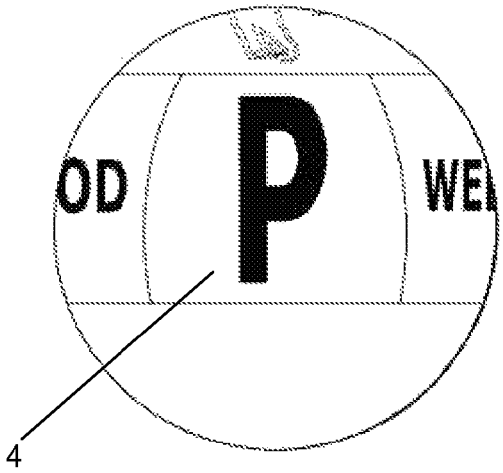
FIG. 4 is a schematic view of the rear of a golf ball according to a first embodiment of the present invention.
Figure 5:
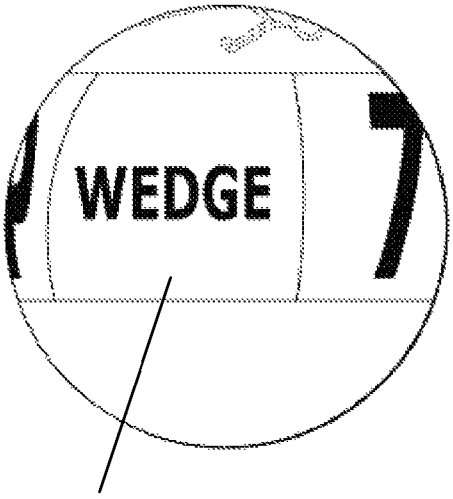
FIG. 5 is a schematic view of a first side of a golf ball according to a first embodiment of the present invention.
Figure 6:
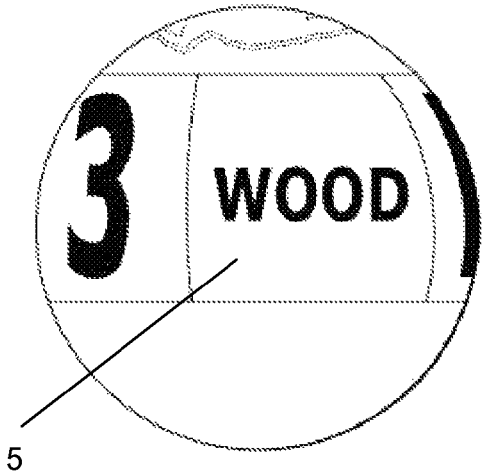
FIG. 6 is a schematic view of a second side of a golf ball according to a first embodiment of the present invention.

Turning to a first embodiment of the invention and referring to FIGS. 1 to 6, there is provided a golf ball 1 comprising seven distinct areas 2, 3, 4, 5, 6, 7, 8 on its surface, the areas being divided by dividing lines 9. Six of the seven distinct areas each contain a marking that relates to a type of golf club.

Area 2 comprises the numeral '3', thus area 2 relates to a 3-iron golf club.

Area 3 comprises the numeral '7', thus area 3 relates to a 7-iron golf club.

Area 4 comprises the letter 'P', thus area 4 relates to a putter golf club.

Area 5 comprises the word 'wood', thus area 5 relates to a wood golf club.

Area 6 comprises the word 'wedge', thus area 6 relates to a wedge golf club.

Area 7 comprises a marking that relates to any pre-selected golf club, as shall be explained in detail below.

Area 8 is blank and does not contain a marking relating to a golf club. However, the area need not be blank and may contain, for example, corporate branding or advertising. Alternatively the area may contain a marking relating to a golf club or a marking relating to some other aspect of a game of golf.

Area 7 is generally pentagonal in shape and covers approximately 17% of the surface of golf ball 1. Area 8 is also generally pentagonal in shape and covers approximately 33% of the surface of golf ball 1. Areas 2, 3, 4, 5 and 6 are generally rectilinear in shape and each cover approximately 10% of the surface of golf ball 1.

It will be apparent that fewer areas and markings could be incorporated on the golf ball. Alternatively, additional areas and markings can be incorporated on the golf ball as set out in the second preferred embodiment of the invention discussed in the specification below.

Using the golf ball as described, a method for playing a game of golf is as follows:

Each player must carry only five clubs, which are:

ii) wood—(any 1-5 wood)

iii) wedge—(any type including pitching, gap, sand or lob)

iv) putter v) 7-iron vi) 3-iron

Thus, along with carrying a 3-iron, 7-iron and a putter, each player must select which type of wood and wedge club they wish to carry.

In addition, each player is provided with golf ball 1 made in accordance with the first embodiment of the present invention as described above, each of which comprises seven areas 2, 3, 4, 5, 6, 7, 8, six of which contain markings.

Before teeing off each player must nominate which of their five clubs is to be their pre-selected club for the whole round. It is this club that corresponds to the marking in area 7 of golf ball 1

Each player tees off in turn, in the usual manner and with a free choice of clubs (from the five carried), using their golf ball.

Before playing the next shot, each player examines the lie of their ball and, depending on its orientation, will select the a club for their next shot in accordance with the following instructions:

i) if the very top of the ball falls in the unmarked area 8, the player may choose which of their five clubs to use for their next shot;

ii) if it falls in the area 2 as denoted by the numeral '3' play the 3-iron;

iii) if it falls in area 3 as denoted by the numeral '7', play the 7-iron;

iv) if it falls in area 4 as denoted by the letter 'P', play the putter;

v) if it falls in area 5 as denoted by the 'wood' marking, the player must play the wood;

vi) if it falls in area 6 as denoted by the 'wedge' marking, play the wedge;

vii) if it falls in area 7 as denoted by the relevant symbol, play their pre-selected club for the remainder of that hole, including the green, and ignoring subsequent lies of their ball. Once the hole has been completed the player reverts to having their club determined by the lie of the ball.

Each subsequent shot by each player takes place in the same way, with the top of each player's ball at each shot determining the club to be used, unless, as stated above, on that hole the lie of the player's ball has determined that they should use their pre-selected club for the rest of the hole.

Once a player's ball has come to rest on the green, its lie is unimportant, in that whichever club was used to play the ball onto the green is the club that must then be used to complete that hole.

If a putter is played from a bunker and the ball both leaves the bunker and ends up closer to the hole than it started, then the player is considered to have completed that hole with that shot.

Once the hole is completed, players tee off at the next hole in the usual manner, with a free choice of clubs, and in an order determined in the usual way, and continue to play that hole, and all subsequent holes, as described above.

Any player whose final shot of a hole is played with the putter, must play their next tee shot from an extra long tee.

Figure 7:
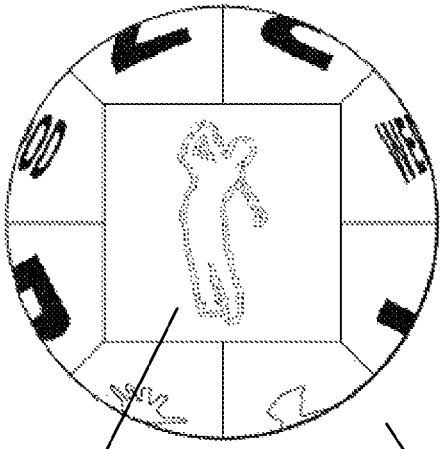
FIG. 7 is a schematic plan view of a golf ball according to a second embodiment of the present invention.
Figure 8:
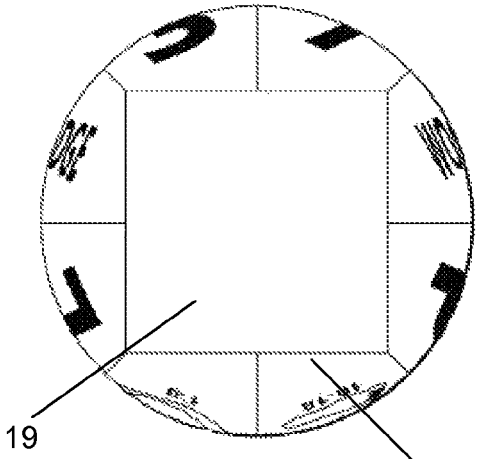
FIG. 8 is a schematic view of the underside of a golf ball according to a second embodiment of the present invention.
Figure 9:
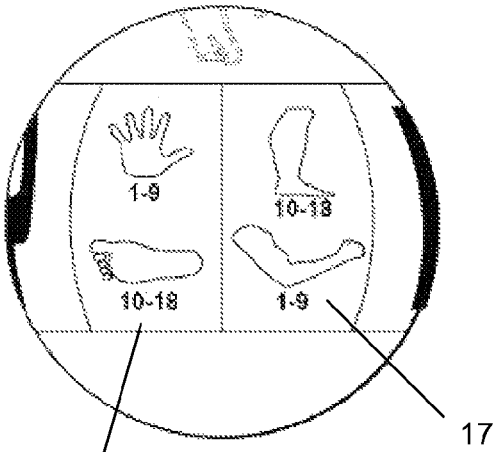
FIG. 9 is a schematic view of the front of a golf ball according to a second embodiment of the present invention.
Figure 10:
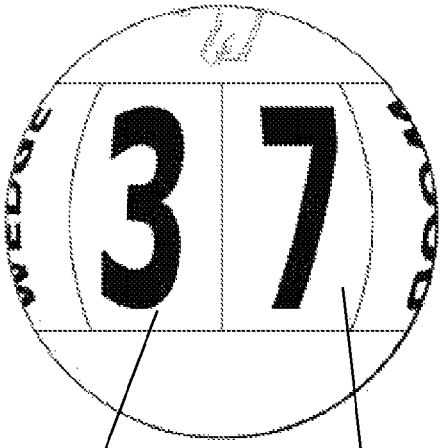
FIG. 10 is a schematic view of the rear side of a golf ball according to a second embodiment of the present invention.
Figure 11:
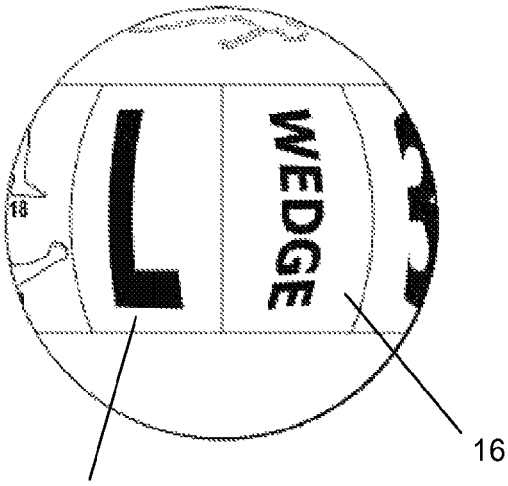
FIG. 11 is a schematic view of a first side of a golf ball according to a second embodiment of the present invention.
Figure 12:
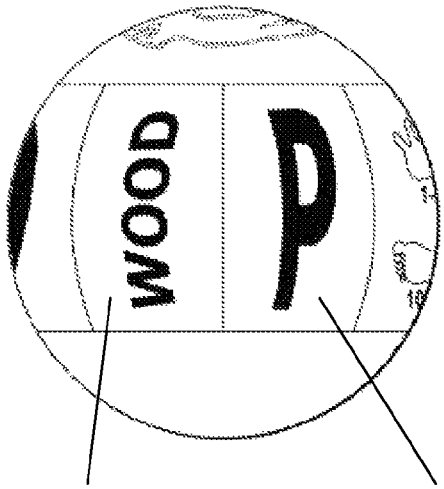
FIG. 12 is a schematic view of a second side of a golf ball according to a second embodiment of the present invention.

At the third and seventh holes, all players must play their 3-iron and 7-iron respectively, for the entire hole, irrespective of any rules above Turning to a second embodiment of the invention, and referring to FIGS. 7 to 12, there is provided golf ball 10 comprising ten distinct areas 11, 12, 13, 14, 15, 16, 17, 18, 19, 20 on its surface, the areas being divided by dividing lines 21. Nine of the ten distinct areas each contain a marking that relates to a type of golf club or method of playing a golf shot.

Area 11 comprises the letter 'L', thus area 11 relates to a left-handed golf club. This presumes, of course, that the player using golf ball 10 is right-handed. If the player using the golf ball is left-handed then the letter 'L' in area 11 will refer to a right-handed golf club. It will be recognised that golf balls for left-handed players comprising the letter 'R' instead of the letter 'L' could be contemplated.

Area 12 comprises the numeral '3', thus area 12 relates to a 3-iron golf club.

Area 13 comprises the numeral '7', thus area 13 relates to a 7-iron golf club.

Area 14 comprises the letter 'P', thus area 14 relates to a putter golf club.

Area 15 comprises the word 'wood', thus area 15 relates to a wood golf club.

Area 16 comprises the word 'wedge', thus area 16 relates to a wedge golf club.

Area 17 comprises arm and leg markings that relate to use of the arms and legs as explained in more detail below.

Area 18 comprises hand and foot markings that relate to use of the hands and feet as explained in more detail below.

Area 19 is blank and does not contain a marking relating to a golf club. However, the area need not be blank and may contain, for example, corporate branding or advertising. Alternatively the area may contain a marking relating to a golf club or a marking relating to some other aspect of a game of golf.

Area 20 comprises a 'wild-card' logo that relates to a choice of actions in a game of golf, as explained in more detail below.

Areas 19 and 20 are each generally square in shape. Area 19 covers approximately 25.5% of the surface of golf ball 10, and area 20 covers approximately 22.5% of the surface of golf ball 10. Areas 11, 12, 13, 14, 15, 16, 17 and 18 are generally rectangular in shape and each cover approximately 6.5% of the surface of golf ball 10.

Using the golf ball as described, a method for playing a game of golf is as follows:

Each player must carry only six clubs, which are:

i) wood—(any 1-5 wood)

ii) wedge—(any type including pitching, gap, sand or lob)

iii) putter iv) 7-iron v) 3-iron vi) a left-handed club of their choice

Thus, along with carrying a 3-iron, 7-iron and a putter, each player must select which type of wood and wedge club they wish to carry.

Although point vi) above states that a left-handed club is to be carried, this applies only to right-handed players. If a player is left-handed they should carry a right-handed club. If a player does not have a left-handed club, they may nominate any one of their five normal clubs to act as the left-handed club for the entire round, and play a left-handed shot using the back side of the club (and vice versa).

In addition, each player is provided with golf ball 10 made in accordance with the second embodiment of the present invention as described above, each of which comprises ten areas 11, 12, 13, 14, 15, 16, 17, 18, 19 and 20, nine of which contain markings.

Each player tees off in turn, in the usual manner and with a free choice of clubs, from the six carried, using their golf ball Before playing the next shot, each player examines the lie of their ball and, depending on its orientation, will select the a club for their next shot in accordance with the following instructions:

i) if the very top of the ball falls in area 11 as denoted by the letter 'L' the player will select the left-handed club (or right-handed club if the player is left-handed);

ii) if it falls in the area 12 as denoted by the numeral '3' play the 3-iron iii) if it falls in area 13 as denoted by the numeral '7', play the 7-iron iv) if it falls in area 14 as denoted by the letter 'P', play the putter v) if it falls in area 15 as denoted by the 'wood' marking, the player must play the wood vi) if it falls in area 16 as denoted by the 'wedge' marking, play the wedge vii) if it falls in area 17 as denoted by 'arm and leg' markings the player must play a one armed shot if they are playing a front nine hole (holes 1-9), or a one legged shot if they are playing a back nine hole (holes 10-18). A one armed shot is one where the player's supporting hand must be behind their back, and a one legged shot is one where the lower half of one leg must be in contact with the back of the other knee;

viii) if it falls in area 18 as denoted by 'hand and foot' markings the player must throw their ball if they are playing a front nine hole (holes 1-9), or kick their ball if they are playing a back nine hole (holes 10-18). When throwing a ball, the player may throw or roll the ball as they choose, but must not move their feet from their position when the ball is picked up;

ix) if it falls in the unmarked area 19, the player may choose which of their six clubs to use for their next shot;

x) if it falls in area 20 as denoted by the 'wild-card' symbol the player has a choice as to how to proceed, as follows:

a) On the first nine holes, the player may choose any one of their clubs and use it for the rest of the hole, or they may choose any one club (except the left handed club) and choose one other player who must play that club for the rest of the hole.

b) On the last nine holes, they may choose to have a free choice of club for each shot over the remainder of the hole (including the green), or they may choose one other player and either choose any club (including the left handed club) for them to play over the remainder of the hole, or for them to play one armed or one legged shots (with free choice of club at each shot for that player, until they reach the green) for the remainder of the hole.

c) On hole numbers which are divisible by 3 (i.e. 3**, 6, 9, 12, 15 & 18), if the player has opted to use a particular club for the rest of the hole themselves, they may take a free kick of their ball before playing their next shot, without incurring a stroke. If the player has instead nominated another player to use a particular club, they may freely kick that player's ball anywhere they choose before they play their next shot, without incurring a stroke for anybody.

d) Once a player has been designated to play with a particular club, (whether that player is the person who played the 'wild-card' or a player on whom the 'wild-card' was played) the lie of their ball on all future shots is unimportant, unless at any stage, including their next shot, the 'wild-card' area lies uppermost, in which case they may select to either i) remain playing with the designated club and designate a particular club to another player, or ii) to reverse the effect of the 'wild-card' and make their own club selection. Once a player's ball is on the green, the lie of their ball has no influence, they cannot be play a 'wild-card', and they cannot have a 'wild-card' played on them.

Each subsequent shot by each player takes place in the same way, with the top of each player's ball at each shot determining the club to be used, unless they have had a 'wild-card' played against them or played a 'wild-card' against themselves.

Once a player's ball has come to rest on the green, its lie is unimportant; whichever club or shot was used to play the ball onto the green is the club that must then be used to complete that hole. In whatever manner a player reaches the green—playing a 7-iron, kicking, throwing, on one leg etc, they must continue to play in this manner and/or with the same club whilst on the green.

If a putter is played from a bunker, and the ball both leaves the bunker and ends up closer to the hole than it started, then the player is considered to have completed that hole with that shot Once a hole is completed, players tee off at the next hole in the usual manner, with a free choice of clubs, and in an order determined in the usual way, and continue to play that hole, and all subsequent holes, as described above. However, the player with the highest (worst) score on a hole may select any one other player to play their next tee shot from an extra long tee.

At the third and seventh holes, all players must play their 3-iron and 7-iron respectively, for the entire hole, irrespective of any rules above In respect of both the first and second embodiments of the invention as described above the following points should be made:

1. The rules, etiquette and scoring of the game are exactly as you would normally choose to play, but you may choose to change your usual scoring system or handicap structure.

2. If a player's ball has come to rest on the green, but their ball then leaves the green through an over hit subsequent shot, the player must continue with the club with which they originally reached the green.

3. If a ball is out of bounds, its lie is unimportant, and it will be returned back into play according to the normal rules, and with the normal penalty applied, with the lie of the ball after dropping it determining the next shot.

4. A player may not take a drop shot in order to avoid playing a shot for which they would not normally take a drop, simply because the club to be used makes that shot particularly unattractive. To avoid this, all drops which would usually incur one penalty stroke (except out of bounds) will instead incur two penalty strokes, except drops from bunkers, which will instead incur three penalty strokes.

5. If the top of the ball falls at the border of two areas, the area nearer the hole is the area which counts, but if two areas are equally close to the hole, the one to the right (as you stand behind the ball) is the area which counts.

6. At the 3rd and 7th holes, the lie of any ball is unimportant.

Any of the above rules may be added, modified or removed, with the following popular changes:

i) Incorporate the use of ladies', men's and competition tees to act as penalties, or agree to all play from the ladies' tees in order to shorten the course and speed up play.

ii) Remove the use of the 3-iron and 7-iron at the third and seventh holes, or additionally introduce their use to the thirteenth and seventeenth holes.

iii) Ignore any of the kick/throw/one leg/one arm areas of the golf ball 10 of the second embodiment, or to change their meaning to suit.

iv) Play with the golf ball 1 of the first embodiment, but adopt the rule of the second embodiment rule that landing area 7 uppermost allows you to select an opponent's next shot.

Conversely, a game may be played with golf balls 10 of the second embodiment, but adopting the rule that landing with area 20 uppermost determines your club for the rest of the hole v) Remove or modify the use of the extra long tee.

According to a third embodiment of the invention the ball of the first embodiment is used in a game, but the rules are different and set out below:

Each player carries only five clubs:

Wood—any 1-5 wood

Wedge—any including pitching, sand or lob

'3'—any long/mid iron or hybrid (1-5)

'7'—any short/mid iron (6-9)

Putter

Before teeing off at the first, each player must select one of their five clubs to be their pre-selected club for the whole round.

At each hole, each player tees off as usual with a free choice of clubs (from the five carried), using their golf ball made in accordance with the first embodiment of the invention. Before playing the next shot, each player examines the lie of their ball, with the top of the ball determining what club must be played next.

Before playing the next shot, each player examines the lie of their ball and, depending on its orientation, will select a club for their next shot in accordance with the following instructions:

i) if the very top of the ball falls in the unmarked area 8, play the pre-selected club;

ii) if it falls in the area 2 as denoted by the numeral '3' play the 3-iron;

iii) if it falls in area 3 as denoted by the numeral '7', play the 7-iron;

iv) if it falls in area 4 as denoted by the letter 'P', play the putter;

v) if it falls in area 5 as denoted by the 'wood' marking, the player must play the wood;

vi) if it falls in area 6 as denoted by the 'wedge' marking, play the wedge;

vii) if it falls in area 7 as denoted by the relevant symbol, the player may choose which of their five clubs to use for each shot until reaching the green, ignoring subsequent lies of the ball;

Each subsequent shot takes place in the same way, with the top of the ball at each shot determining the club to be used (with the exception at point vii above).

Once the green has been reached the putter is used.

Each player uses a golf ball made in accordance with the first embodiment of the present invention which is a different colour to those of their opponents.

If a ball is dropped, it is the lie of the ball after dropping it that determines the next club to be used, unless the player already had a free choice of clubs.

The top of the ball is determined by standing directly over the ball and looking straight down on it.

If the top of the ball falls at the border of two areas, the area nearer the hole is the area which counts, but if the two areas are equally close to the hole, the one to the right (as the player stands behind the ball, facing the hole) is the area which counts.

Evidently the rules of the third embodiment are open to alteration without departing from the scope of the invention.

It will be clear that many variations from the above preferred embodiments are possible whilst remaining within the scope of the invention.

The markings on the golf ball may be made in numerous different fashions; they may be colours, pictures of clubs, words, numerals, symbols, shapes and letters. Indeed, any marking that is able to purport significance to a player may be used.

The markings need not be bounded by dividing lines 9 & 21. However, such an arrangement is preferable as it allows the user to determine more easily which marking is to be taken into account when determining the course of the game.

The markings may represent any conceivable future action in the game of golf, and are not limited to the club or method to be used on the next shot. For example, a marking could relate to a penalty incurred or to a reduction in score. A marking could relate to a player having to play a shot with their eyes closed or in any other manner. These are non-exhaustive examples of what the markings could relate to.

Any number of markings could be used on the golf balls 1 & 10. Although the preferred embodiments use seven and ten different areas, the surface of the balls could be divided up into any other number of areas. The same marking may appear more than once on any given golf ball.

The invention is not limited to use of golf balls 1 & 10 on a standard golf course. The balls may be used in other styles of golf game such as 'crazy golf' and 'pitch and putt'. Different type of balls may be employed for these styles of game if desired.

It will also be appreciated that when using a golf ball made in accordance with the present invention, although the uppermost marking on the golf ball is used in the preferred embodiments to be determinative of a future action in the game, other orientations could be used. For example the lowermost marking on the golf ball could be determinative.

While the invention has been illustrated and described in detail in the drawings and foregoing description, the same is to be considered as illustrated and not restrictive in character, it being understood that only the preferred embodiment and a few alternative embodiments have been shown and described and that all changes and modifications that come within the spirit of the invention are desired to be protected.

What is claimed is:

1. A golf ball employed in a game of golf, to dictate a player action subsequent to a striking thereof, said golf ball comprising:

a golf ball having an exterior surface, said exterior surface having a plurality of markings thereon;

dividing lines are positioned upon said exterior surface of said golf ball as a separation between at least some of the markings which are located in areas on the exterior surface of the golf ball;

each said marking related to a respective action, from a plurality of actions, which a player may be required to employ during said golf game;

a contact of a said exterior surface of said golf ball coming to rest on a course surface, subsequent to a first striking of said ball by said player using a club, thereby positioning the plurality of markings at a particular orientation, said orientation dictating a respective said action from said plurality of actions, said player must employ prior to or during a subsequent striking of said golf ball by said player during said game; and said respective said action requiring a respective individual golf club, from a respective plurality of said golf clubs carried by each said player, which said player must employ for a future shot.

2. The game of claim 1 wherein at least one of the markings positionable to said orientation is determinative of a said action requiring an individual golf club, from a respective plurality of said golf clubs carried by each said player, which said player must employ for a future shot.

3. The golf ball of claim 1 wherein six said markings, from said plurality of markings, are determinative of a said action requiring a respective individual golf club, from a plurality of said golf clubs carried by each said player, which said player must employ for a future shot.

4. The golf ball of claim 1 wherein each of the markings, from said plurality of markings, when positioned to a respective said orientation, represents a different respective said action to be taken by said player in said game of golf.

5. The golf ball of claim 1 wherein at least one said marking, positioned to a respective said orientation, is determinative of a said action relating to a style in which a future shot is to be played by said player.

6. The golf ball of claim 1 wherein the plurality of said markings positioned on said exterior surface of said golf ball comprises at least six different said markings.

7. The golf ball of claim 1 wherein the plurality of said markings positioned on said exterior surface of said golf ball comprises at least seven different said markings.

8. The golf ball of claim 1 wherein at least one of the markings from said plurality of markings, designates a wood as said individual golf club, from said plurality of golf clubs.

9. The golf ball of claim 1 wherein at least one of the markings from said plurality of markings designates a wedge as said individual golf club, from said plurality of golf clubs.

10. The golf ball of claim 1 wherein at least one of the markings from said plurality of markings designates a putter as said individual golf club, from said plurality of golf clubs.

11. The golf ball of claim 1 wherein two of the markings from said plurality of markings designate respective irons as said individual golf club from said plurality of golf clubs.

12. The golf ball of claim 11 wherein one of the two markings designating respective said irons as said individual club, determines the use of a 3-iron as said individual club and another of the two markings a 7-iron as said individual club.

13. The golf ball of claim 1 wherein at least one of the markings from said plurality of markings determines a said action that the player is to use a pre-selected club on a said subsequent shot, which has been previously chosen before beginning said game of golf.

14. The golf ball of claim 13 wherein the pre-selected club has been voluntarily pre-selected by a player.

15. The golf ball of claim 1 wherein the marking positionable to said orientation which determine a said action allowing that a player may choose which golf club from a plurality of golf clubs employed for said golf game, to use on a future shot, is a blank area upon said exterior surface.

16. The golf ball of claim 1 wherein the future shot is the next shot to be taken by a player during said golf game using the golf ball.

17. The golf ball of claim 1 wherein at least one of the markings from said plurality of markings positioned on said surface of said ball, determines a said action allowing that the player having struck said ball to position it in said orientation, may select a golf club from a said plurality of clubs for a different player to use on a future shot during said golf game.

18. The golf ball of claim 1 wherein dividing lines provide a respective said separation between all of the markings which are located in areas on the exterior surface of the golf ball.

19. A method of playing a game of golf employing a golf ball having an exterior surface having a plurality of markings thereon where each said marking is related to a respective action from a plurality of actions which a player may be required to employ during said golf game, and where a contact of a said exterior surface of said golf ball coming to rest on a course surface subsequent to a first striking of said ball by said player using a club thereby positions the plurality of markings at a particular orientation dictating a respective said action from said plurality of actions which said player must employ prior to or during a subsequent striking of said golf ball by said player during said game, comprising the steps of:

I) providing at least one said player with a said golf ball having a said plurality of markings on said exterior surface;

ii) allowing the player playing to take a shot with the golf ball by striking it with a golf club;

iii) when the golf ball has come to rest employing the said marking positioned in said orientation to determine a said future action to be taken by said player who took said shot with said golf ball, in the game of golf.

20. The method of claim 19 wherein the player is provided with a selection of a plurality of said golf clubs.

21. The method of claim 20 whereby before the game of golf begins each player pre-selects one or more clubs from a respective said plurality of clubs for employment as said determined golf club in a respective relation to at least one of the markings from said plurality of markings located on said exterior surface of a respective said golf ball to be used by each respective said player.

22. The method of claim 20 whereby when the golf ball has come to rest upon said playing surface, said orientation of said marking to be employed as determinative of said future action to be taken by said player, is an uppermost marking on the golf ball relative to a resting point of said exterior surface of said golf ball on said playing surface.

23. The method of claim 20 whereby a plurality of the plurality of markings upon a respective positioning in said orientation, dictate a said action which is determinative of the type of golf club from said plurality of clubs, that a player uses for a future shot.

24. The method of claim 20 whereby at least one of the plurality of markings upon a positioning in said orientation, determines a said future action where a determined said golf club from said plurality of golf clubs is to be used by a player for a future shot.

25. The method of claim 24 whereby said player having a said ball with a said marking in said orientation continues to use the determined golf club for all strikings of said ball until a subsequent hole of golf is completed regardless of any subsequent said orientation of any respective said marking on said exterior surface of the golf ball.

26. The method of claim 24 whereby when a player's golf ball lands on a green of said playing surface, the player will continue to use the determined club with which they took their most recent shot for all subsequent said shots, until a hole of said game of golf is completed.

* * * * *